US008790100B2

(12) United States Patent
Tsuboi et al.

(10) Patent No.: US 8,790,100 B2
(45) Date of Patent: Jul. 29, 2014

(54) SCREW EXPANDER

(75) Inventors: Noboru Tsuboi, Kako-gun (JP); Masayoshi Matsumura, Takasago (JP)

(73) Assignee: Kobe Steel, Ltd., Kobe-shi (JP)

( * ) Notice: Subject to any disclaimer, the term of this patent is extended or adjusted under 35 U.S.C. 154(b) by 441 days.

(21) Appl. No.: 13/238,246

(22) Filed: Sep. 21, 2011

(65) Prior Publication Data

US 2012/0082580 A1 Apr. 5, 2012

(30) Foreign Application Priority Data

Oct. 4, 2010 (JP) ..... 2010-224945

(51) Int. Cl.
*F01C 1/16* (2006.01)

(52) U.S. Cl.
USPC ..... 418/201.2

(58) Field of Classification Search
USPC ..... 418/201.2
See application file for complete search history.

(56) References Cited

U.S. PATENT DOCUMENTS

| | | | | |
|---|---|---|---|---|
| 4,608,829 | A | 9/1986 | Horiguchi et al. | |
| 5,082,427 | A * | 1/1992 | Fujiwara et al. | 417/292 |
| 2001/0046443 | A1 | 11/2001 | Van De Putte | |
| 2004/0247465 | A1 | 12/2004 | Yoshimura | |
| 2008/0286087 | A1 | 11/2008 | Nagesh et al. | |
| 2009/0308471 | A1 | 12/2009 | Heimonen | |

FOREIGN PATENT DOCUMENTS

| | | | |
|---|---|---|---|
| CN | 101163885 | A | 4/2008 |
| EP | 1 128 067 | A1 | 8/2001 |
| JP | 61-122301 | U | 8/1986 |
| JP | 62-60902 | | 3/1987 |
| JP | 2003-97480 | | 4/2003 |
| JP | 3904852 | | 1/2007 |
| JP | 3904852 | B2 | 4/2007 |
| WO | WO 2006/095364 | A1 | 9/2006 |

OTHER PUBLICATIONS

The Extended European Search Report issued Feb. 6, 2012 in Patent Application No. 11182861.2.
Office Action issued Feb. 19, 2013, in Japanese Patent Application No. 2010-224945 with English translation.
Office Action issued Jun. 25, 2013 in Korean Patent Application No. 10-2011-99597 with English language translation and Japanese language translation.
Tatushi Kaneko, et al., "Study on Fundamental Performance of Helical Screw Expander", Transactions of the Japan Society of Mechanical Engineers (Series B), No. 461, vol. 51, Jan. 1985, pp. 134-142.
Korean Office Action issued Dec. 20, 2012, in Korea Patent Application No. 10-2011-0099597 (with English translation).

* cited by examiner

*Primary Examiner* — Charles Freay
(74) *Attorney, Agent, or Firm* — Oblon, Spivak, McClelland, Maier & Neustadt, L.L.P.

(57) ABSTRACT

A screw expander in which a pair of male and female screw rotors engaged with each other are housed in a rotor chamber formed in a casing, an expansion force of a high-pressure gas supplied from an intake flow path to the rotor chamber is converted into a rotational force by the screw rotors and the expanded low-pressure gas is exhausted to an exhaust flow path includes a valve mechanism capable of allowing communication between an intermediate pressure portion, which is a space in the rotor chamber and can be separated from the intake flow path and the exhaust flow path by the screw rotors, and a bypass flow path, to which a high-pressure gas is supplied, and a controller for controlling the valve mechanism in accordance with an operation expansion ratio which is a ratio of a pressure in the intake flow path to a pressure in the exhaust flow path.

5 Claims, 11 Drawing Sheets

SCREW EXPANDER

BACKGROUND OF THE INVENTION

1. Field of the Invention

The present invention relates to a screw expander.

2. Description of the Related Art

Power generation systems in which a generator is driven by the flash of steam are widely introduced. Conventionally, there have been many large-scale facilities using turbo and axial-flow turbines. However, in terms of saving energy, there have been recently increasing needs for small-scale power generation systems for generating power by recovering exhaust heat.

The use of a screw expander instead of a turbine is known to be efficient in small-scale facilities as disclosed, for example, in "Study on Fundamental Performance of Helical Screw Expander" in Transactions of the Japan Society of Mechanical Engineers (Series B), pp. 134-142, No. 461, Vol. 51, published on Jan. 1985. Generally, in a screw expander, a ratio of a volume during intake to a volume during exhaust is determined by a mechanical shape and an internal expansion ratio as a ratio of an intake pressure and an exhaust pressure inside is constant. Thus, as disclosed in the above literature, a loss occurs if the internal expansion ratio of the screw expander does not coincide with an operation expansion ratio as a ratio of a pressure at an intake side and a pressure at an exhaust side.

As a means for adjusting an internal expansion ratio of a screw expander, there is a method for changing an exhaust position by a slide valve as disclosed in Japanese Unexamined Patent Publication No. S62-60902. However, this method is disadvantageous in that a mechanism for driving the slide valve is required and an apparatus becomes complicated and large.

As a system for generating power by low-temperature heat with which flash power generation cannot be utilized, there is a binary power generation system in which a turbine and an expander are driven by a low-boiling heat medium, for example, as disclosed in U.S. Pat. No. 4,608,829. Since the binary power generation system has, in principle, low power generation efficiency, it is hardly put to practical use except for such cases where a huge heat source is present despite having such a temperature at which steam cannot be flashed as in geothermal power generation.

However, if a small-size binary power generation system can be inexpensively provided, heat which has not been conventionally utilized at all, e.g. heat discarded to cool a cylinder block of an internal combustion engine can also be recovered as electrical energy. To make such a power generation system economically rational, it is very important to make the screw expander more efficient.

Japanese Patent No. 3904852 discloses a screw compressor which has a simple structure and can reduce a starting torque and smoothly start without causing overload of a motor by providing a piston valve which allows a space at an intake side and an intermediate pressure portion to communicate using an intake pressure and an exhaust pressure as drive forces. This can be said to disclose a screw expander whose mechanical compression ratio (internal compression ratio) changes only at the time of start, but does not disclose a technology applicable to a screw expander as it is.

SUMMARY OF THE INVENTION

In view of the above needs, the present invention aims to provide a screw expander which is highly efficient while being inexpensive and small in size.

To solve the above problem, the present invention is directed to a screw expander, comprising a casing; an intake flow path provided in the casing; an exhaust flow path provided in the casing; a pair of male and female screw rotors housed in a rotor chamber formed in the casing and engaged with each other, the screw rotors converting an expansion force of a high-pressure gas supplied from the intake flow path to the rotor chamber into a rotational force and exhausting a low-pressure gas after expansion to the exhaust flow path; a bypass flow path provided in the casing and communicating with the intake flow path; a valve mechanism capable of selectively allowing communication between an intermediate pressure portion, which is a space in the rotor chamber and can be separated from the intake flow path and the exhaust flow path by the screw rotors, and the bypass flow path; an intake pressure detector for detecting a pressure in the intake flow path; an exhaust pressure detector for detecting a pressure in the exhaust flow path; and a controller for controlling the valve mechanism in accordance with an operation expansion ratio which is a ratio of the pressure in the intake flow path detected by the intake pressure detector to the pressure in the exhaust flow path detected by the exhaust pressure detector.

According to this construction, an expansion stroke starts from the moment of separation from the intermediate pressure portion since the high-pressure gas is supplied from the bypass flow path to the intermediate pressure portion by the valve mechanism. Since an internal expansion ratio can be made substantially smaller by this, operation efficiency can be improved by changing the internal expansion ratio in accordance with the operation expansion ratio. Further, since the shape of the casing does not need to be substantially changed unlike with a slide valve and the construction is simple, it is possible to provide a screw expander which is small in size and inexpensive while being highly efficient.

In the screw expander of the present invention, the intermediate pressure portion may be so formed as to communicate with the intake flow path depending on angles of the screw rotors.

According to this construction, since the pressure of a gas does not change between a space communicating with the intake flow path and an intermediate space, there is the same effect as in the case where a stroke volume at the time of starting expansion is increased by enlarging an intake port. Further, there is no loss caused by re-compression since a fluid does not expand between the intake flow path and the intermediate space.

In the screw expander of the present invention, the controller may cause the valve mechanism to allow communication between the intermediate pressure portion and the bypass flow path when the operation expansion ratio is equal to or below a predetermined set value.

According to this construction, the occurrence of a loss can be reduced by approximating the internal expansion ratio to the operation expansion ratio.

In the screw expander of the present invention, the valve mechanism may include an intake valve; an exhaust valve; a column-shaped space which has a functional end surface communicating with the intermediate pressure portion and the bypass flow path and communicates with the bypass flow path via the intake valve and communicates with the exhaust flow path via the exhaust valve at a side opposite to the functional end surface; and a piston which is fitted in the column-shaped space and separates the intermediate pressure portion and the bypass flow path by coming into contact with the functional end surface.

According to this construction, a drive source for the valve mechanism is not necessary since the valve mechanism is driven by the pressure in the intake flow path and the pressure in the exhaust flow path.

In the screw expander of the present invention, the functional end surface may be open at the peripheral edge of an intake-side end surface of the rotor chamber.

According to this construction, the valve mechanism can be relatively easily incorporated into a general casing having a split construction and the screw expander does not become larger.

DETAILED DESCRIPTION OF THE PREFERRED EMBODIMENTS

Figure 1:
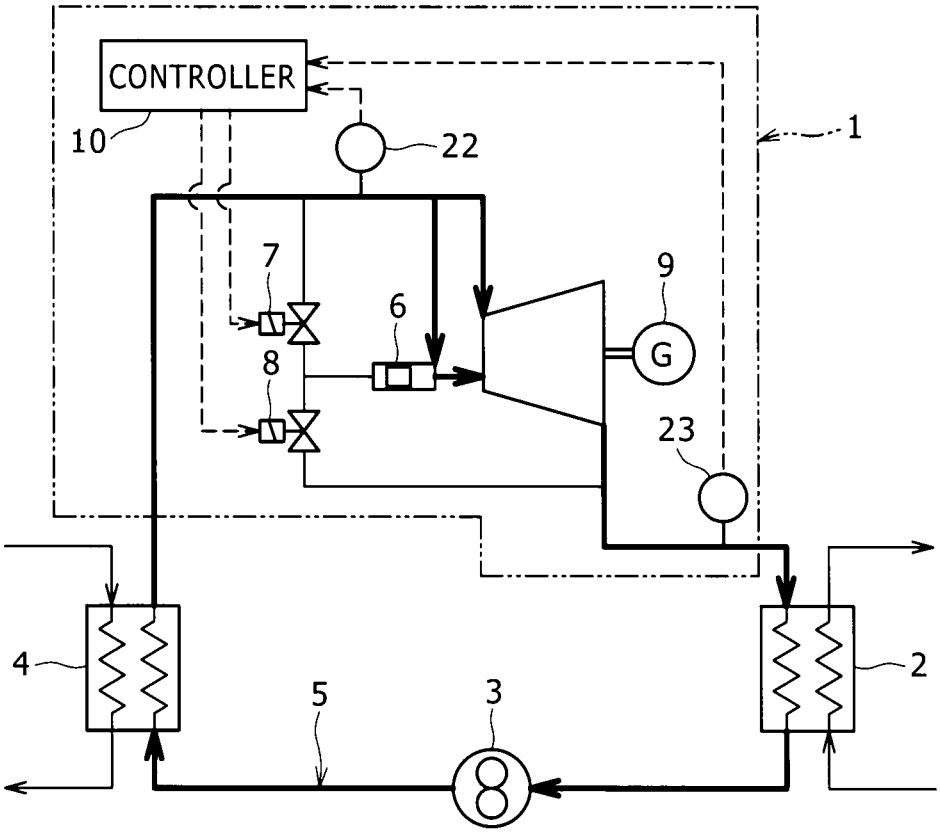
FIG. 1 is a construction diagram of a binary power generation system including a screw expander according to a first embodiment of the present invention.

Hereinafter, embodiments of the present invention are described with reference to the drawings. FIG. 1 shows the construction of a binary power generation system including a screw expander 1 as a first embodiment of the present invention. The binary power generation system is such that a heat medium such as R245fa is sealed in a heat medium circulating flow path 5 connecting the screw expander 1, a condenser 2, a pump 3 and an evaporator 4. A generator 9 is connected to an output shaft of the screw expander 1.

In this binary power generation system, the heat medium, which is a fluid, has the pressure thereof boosted to a pressure Ps by the pump 3, is supplied to the evaporator 4, and is evaporated into a gas in the evaporator 4. By expanding the heat medium in the screw expander 1, an expansion force thereof is converted into a rotational force, which is converted into electric power by the generator 9. The heat medium having a reduced pressure due to expansion in the screw expander 1 is cooled and liquefied in the condenser 2, and the liquefied heat medium is re-supplied to the evaporator 4 by the pump 3.

The screw expander 1 includes a piston valve (valve mechanism) 6 to be described later. The heat medium is supplied to the piston valve 6 via an intake valve 7 at the same high pressure Ps as it is supplied to the screw expander or supplied via an exhaust valve 8 at the same low pressure Pd as it is exhausted from the screw expander.

An intake pressure detector 22 for detecting the value of the high pressure Ps is provided in the heat medium circulating flow path 5 at an upstream side of the screw expander 1. An exhaust pressure detector 23 for detecting the value of the low pressure Pd is provided in the heat medium circulating flow path 5 at a downstream side of the screw expander 1. The respective pressure values detected by the intake pressure detector 22 and the exhaust pressure detector 23 are input to a controller 10. The controller 10 performs a process as described later using these pressure values and controls the opening and closing of the intake valve 7 and the exhaust valve 8 based on the result of the process.

Figure 2:
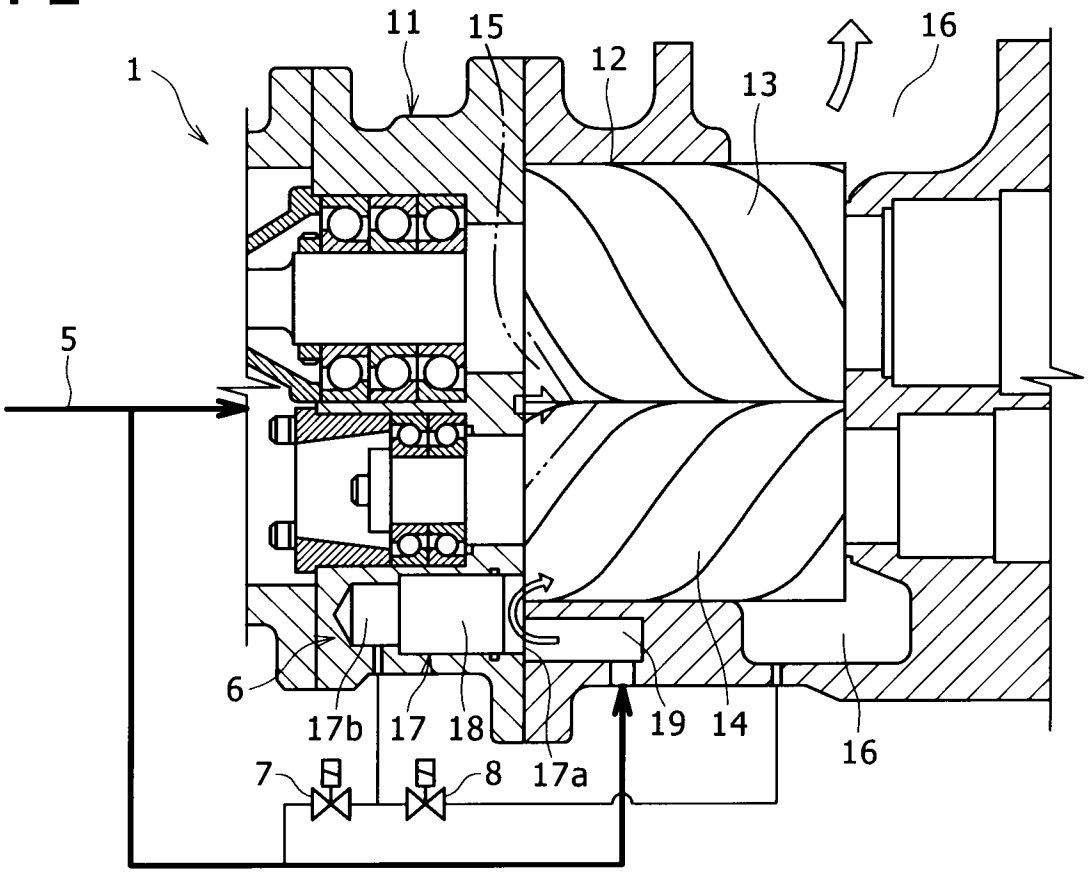
FIG. 2 is a sectional view showing an axial-direction part of the screw expander according to the first embodiment of the present invention.

FIG. 2 shows the detail of the screw expander 1. The screw expander 1 is such that a pair of male and female screw rotors 13, 14 engaged with each other are housed in a rotor chamber 12 formed in a casing 11. A high-pressure heat medium is supplied from an intake flow path 15 to the rotor chamber 12 and expands in tooth grooves of the screw rotors 13, 14, whereby the screw rotors 13, 14 are rotated. The heat medium expanded in the rotor chamber 12 is exhausted via an exhaust flow path 16.

Here, the construction of the piston valve 6 is described. The piston valve 6 includes a column-shaped space 17 formed in the casing 11 and a piston 18 slidably fitted in the column-shaped space 17. One end of the column-shaped space 17 is a functional end surface 17*a* which is open at the peripheral edge of an intake-side end surface of the rotor chamber 12 so as to communicate with an intermediate pressure portion which is a space in the rotor chamber 12 and can be separated from the intake flow path 15 by the tooth of the screw rotor 14. Further, the functional end surface 17*a* also opens to a bypass flow path 19 that is formed in the casing 11 at the outer side of the rotor chamber 12 and that extends in an axial direction. The piston 18 can separate the intermediate pressure portion of the rotor chamber 12 and the bypass flow path 19 by coming into contact with the functional end surface 17*a*.

The column-shaped space 17 can communicate with the intake flow path 15 through the circulating flow path 5 via the intake valve 7 and can also communicate with the exhaust flow path 16 via the exhaust valve 8 in a driving portion 17*b* at a side of the piston 18 opposite to the functional end surface 17*a*. Further, the bypass flow path 19 is connected to the circulating flow path 5 at the intake side and a heat medium having a high pressure (Ps) is supplied thereto.

Figure 3:
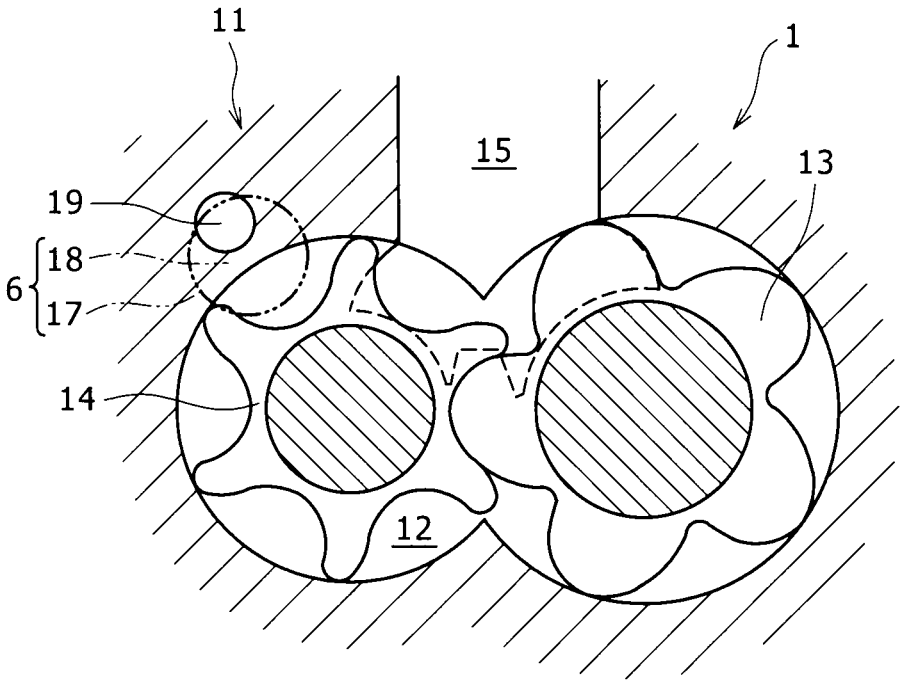
FIG. 3 is a sectional view showing a part perpendicular to an axis of the screw expander of FIG. 2.

FIG. 3 shows a cross section of the screw expander 1 in a direction perpendicular to the axial direction on the intake-side end surface of the rotor chamber 12. As shown in FIG. 3, the intermediate pressure portion communicating with the column-shaped space 17 is a space in a tooth groove separated from the intake flow path 15 by the tooth of the screw rotor 14. However, the intermediate pressure portion communicating with the column-shaped space 17 can communicate with the intake flow path 15 depending on a rotation angle of the screw rotor 14.

When the intake valve 7 is opened and the exhaust valve 8 is closed, a pressure in the driving portion 17*b* of the column-shaped space 17 becomes equal to the intake pressure Ps. When the intermediate pressure portion is separated from the intake flow path 15 by the tooth of the screw rotor 14, the heat medium in the intermediate pressure portion slightly expands and the pressure is reduced from the intake pressure Ps. This causes the pressure at the side of the functional end surface 17*a* of the column-shaped space 17 to become slightly lower than the pressure at the side of the driving portion 17*b*, whereby the piston 18 is moved toward the functional end surface 17*a*. When coming into contact with the functional end surface 17*a*, the piston 18 seals the functional end surface 17*a* to separate the bypass flow path 19 and the intermediate pressure portion. Thus, the screw expander 1 comes to have the same construction as a normal expander including no bypass flow path 19.

When the intake valve 7 is closed and the exhaust valve 8 is opened, the pressure in the driving portion 17*b* of the column-shaped space 17 becomes equal to the exhaust pressure Pd and lower than the pressure at the functional end surface 17*a* communicating with the bypass flow path 19 having the pressure Ps and the intermediate pressure portion having the same pressure Ps as in the intake flow path 15 or a pressure slightly lower than Ps due to slight expansion of the heat medium. This causes the piston 18 to move in a direction away from the functional end surface 17*a*, thereby ensuring communication between the bypass flow path 19 and the intermediate pressure portion and allowing the heat medium to flow into the intermediate pressure portion from the bypass flow path 19. Then, the pressure in the intermediate pressure portion is maintained at the intake pressure Ps also when the intermediate pressure portion is separated from the intake flow path 15 by the tooth of the screw rotor 14.

Figure 4:
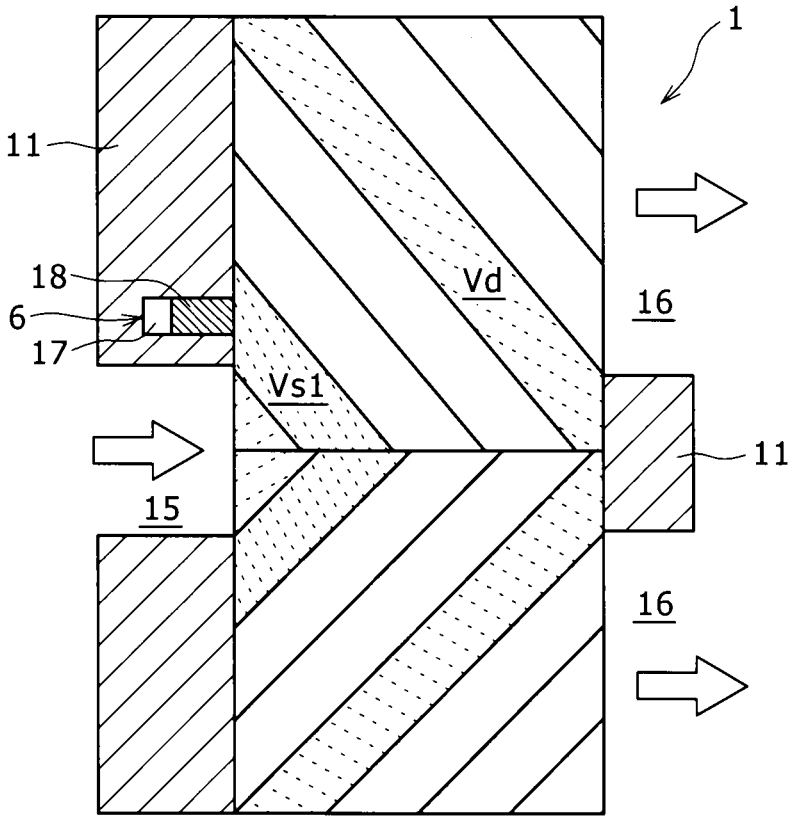
FIG. 4 is a development view of screw rotors when a valve mechanism of the screw expander of FIG. 2 is closed.

FIG. 4 shows a development view of the screw rotors 13, 14 in a state where the piston valve 6 is closed (the functional end surface 17*a* is sealed by the piston 18). The heat medium having the intake pressure Ps is supplied to the tooth grooves of the screw rotors 13, 14 from the intake flow path 15. A volume Vs1 of the tooth grooves at the moment of separating the tooth grooves of the screw rotors 13, 14 from the intake flow path 15 by the casing 11 is a volume when the heat medium having the pressure Ps starts expanding in the screw expander 1. A volume Vd of the tooth grooves at the moment of being released from the casing 11 at the discharge side and communicating with the exhaust flow path 16 is a volume when the expansion of the heat medium ends. Between a ratio of these volumes Vi=Vd/Vs1 and an internal expansion ratio Hi, there is a relationship $Vi=\Pi i^{1/K}$ if K denotes a specific heat ratio of the heat medium. Thus, when Vs1 is 37% of Vd, the volume ratio Vi=2.7 and the internal expansion ratio ⌈i=3.3 if the specific heat ratio K is 1.2.

Figure 5:
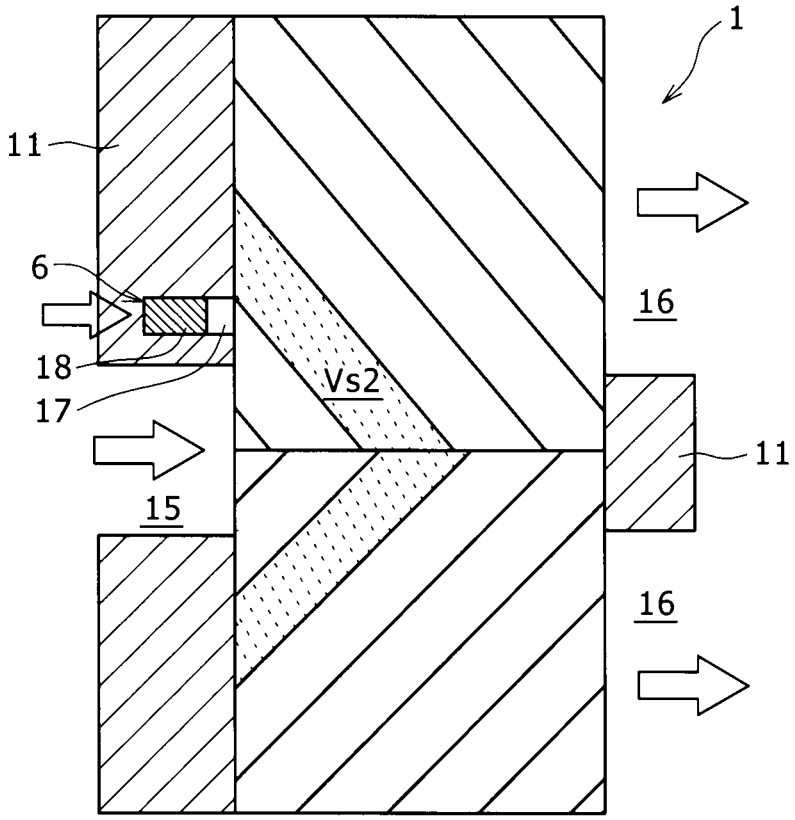
FIG. 5 is a development view of the screw rotors when the valve mechanism of the screw expander of FIG. 2 is opened.

FIG. 5 shows a development view of the screw rotors 13, 14 in a state where the piston valve 6 is open (the piston 18 is moved toward the driving portion 17*b*). In this case, even if the intermediate pressure portion is separated from the intake flow path 15, the heat medium having the intake pressure Ps is supplied to the tooth groove communicating with the piston valve 6 via the bypass flow path 19. That is, the opening of the piston valve 6 brings about substantially the same effect as enlargement of the intake flow path 15. Accordingly, a volume Vs2 of the tooth grooves at the moment of separation from the piston valve 6 is a volume when the heat medium having the pressure Ps starts expanding in the screw expander 1. The volume Vd when the expansion of the heat medium ends is the same as in the case where the piston valve 6 is closed. When the Vs2 is 47% of Vd, the volume ratio Vi=2.1 and the internal expansion ratio Πi is 2.5.

In the screw expander 1, when the operation expansion ratio Ps/Pd is larger than a predetermined set value Πth (e.g. 2.5), the piston valve 6 is closed for operation with the internal expansion ratio Πi=3.3. When the operation expansion ratio Ps/Pd falls to or below the set value 11th, the piston valve 6 is opened for operation with the internal expansion ratio Πi=2.5. In this way, the internal expansion ratio Πi is approximated to the operation expansion ratio Ps/Pd to improve conversion efficiency from thermal energy into rotational energy and, consequently, power generation efficiency of the binary power generation system can be improved.

More specifically, in the controller 10, the operation expansion ratio is calculated as a ratio of the pressure in the intake flow path detected by the intake pressure detector 22 to the pressure in the exhaust flow path detected by the exhaust pressure detector 23. If the calculated operation expansion ratio is larger than a predetermined set value, the controller 10 outputs a signal commanding the opening of the intake valve 7 and the closing of the exhaust valve 8 to separate the bypass flow path 19 and the intermediate pressure portion. If the calculated operation expansion ratio is smaller than the predetermined set value, the controller 10 outputs a signal commanding the closing of the intake valve 7 and the opening of the exhaust valve 8 to allow communication between the bypass flow path 19 and the intermediate pressure portion.

Since the screw expander 1 changes the internal expansion ratio Πi by the simple piston valve 6, it does not become larger and can be relatively inexpensively provided.

Figure 6:
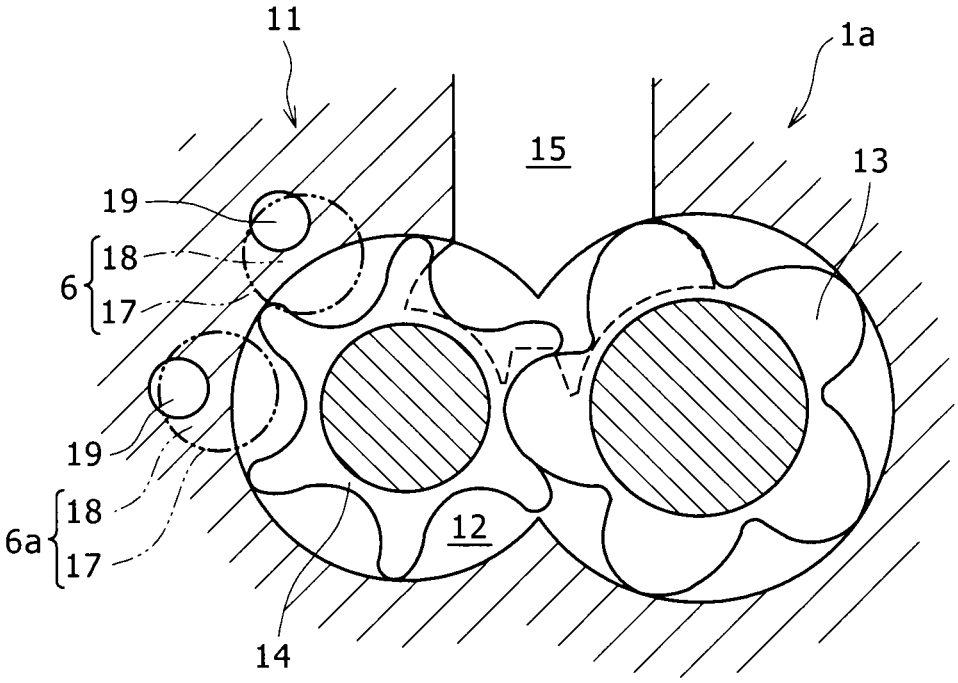
FIG. 6 is a sectional view showing a part perpendicular to an axis of a screw expander according to a second embodiment of the present invention.

Next, FIG. 6 shows a sectional view perpendicular to an axis of a screw expander 1*a* according to a second embodiment of the present invention. Note that the same elements as those of the first embodiment are denoted by the same reference numerals and not repeatedly described in the description of the following embodiments.

The screw expander 1*a* of this embodiment includes a piston valve 6*a* at a position (intermediate pressure portion) corresponding to a tooth groove at an advanced rotational position of a screw rotor 14 in addition to the same piston valve 6 as in the first embodiment. The construction of the piston valve 6*a* is the same as the piston valve 6 except its angular position.

Figure 7:
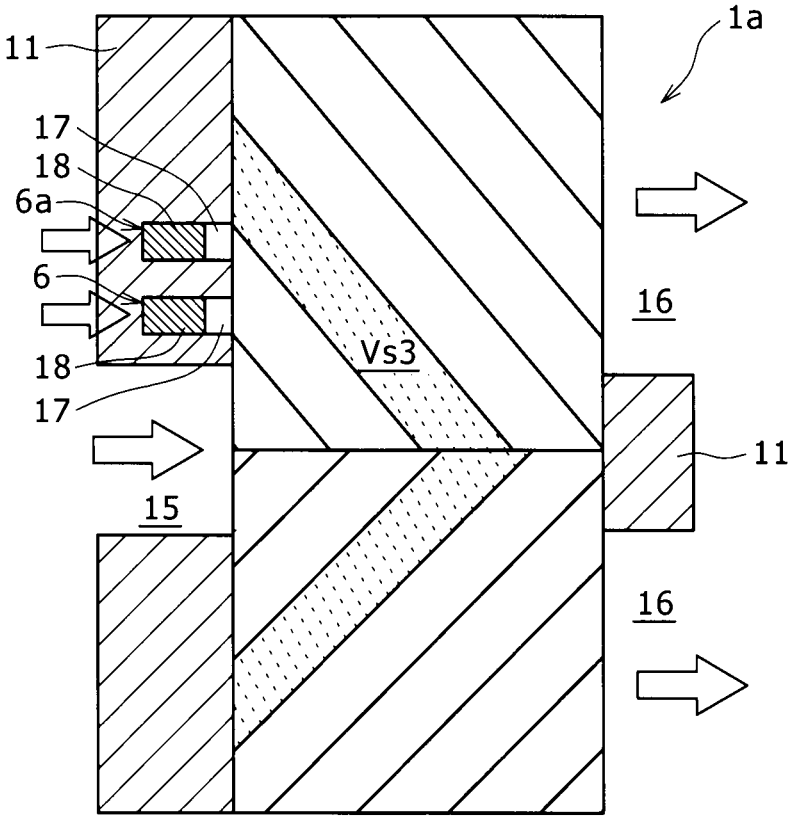
FIG. 7 is a development view of screw rotors of the screw expander of FIG. 6.

FIG. 7 shows a development view of screw rotors 13, 14 of the screw expander 1*a*. In this embodiment, an intake flow path 15 can be substantially further enlarged and a volume when a heat medium having a pressure Ps starts expanding can be further increased to Vs3 by opening the piston valve 6*a* in addition to the piston valve 6. When Vs3 is 56% of Vd, a volume ratio Vi=1.8 and an internal expansion ratio Πi=2.0.

In this embodiment, when an operation expansion ratio Ps/Pd falls to or below a set value Πth1=2.5, the piston valve 6 is opened. Further, when the operation expansion ratio Ps/Pd falls to or below a set value Πth2=2.0, the piston valve 6*a* is opened. By changing the internal expansion ratio Πi in a stepwise manner in accordance with a change in the operation expansion ratio Ps/Pd, high conversion efficiency can be achieved in a wider range of the operation expansion ratio Ps/Pd.

Figure 8:
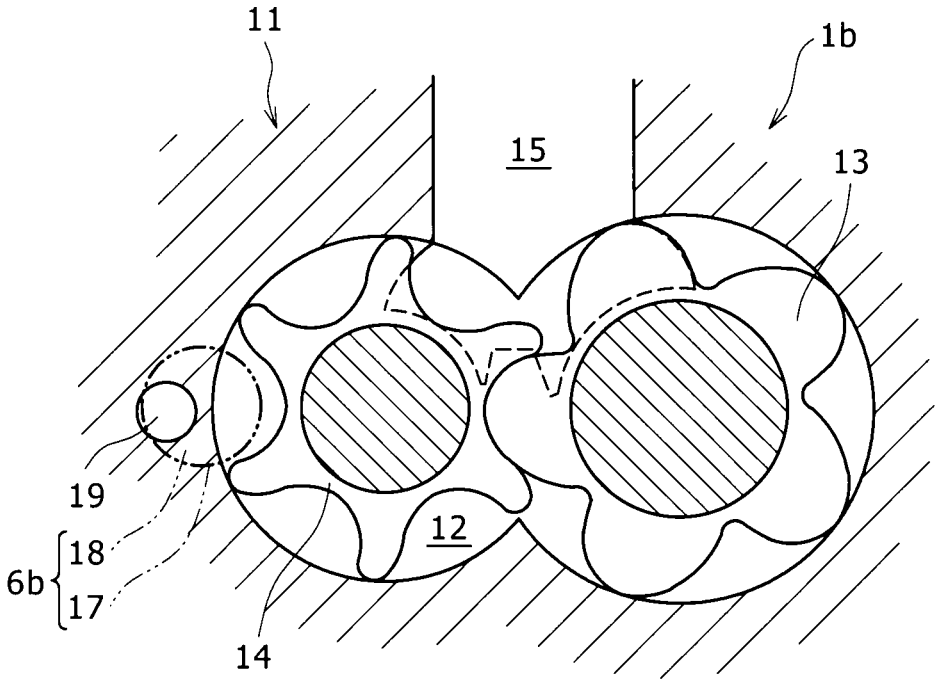
FIG. 8 is a sectional view showing a part perpendicular to an axis of a screw expander according to a third embodiment of the present invention.

FIG. 8 shows a sectional view perpendicular to an axis of a screw expander 1*b* according to a third embodiment of the present invention. In the screw expander 1*b* of this embodiment, a piston valve 6*b* is provided at a position distant from an intake flow path 15 by a distance longer than a tooth pitch of a screw rotor 14 in a circumferential direction. That is, in this embodiment, an intermediate pressure portion, to which a heat medium having an intake pressure Ps can be supplied via the piston valve 6*b*, does not communicate with the intake flow path 15 in any way as long as the piston valve 6*b* is not opened regardless of the angular position of the screw rotor 14.

Figure 9:
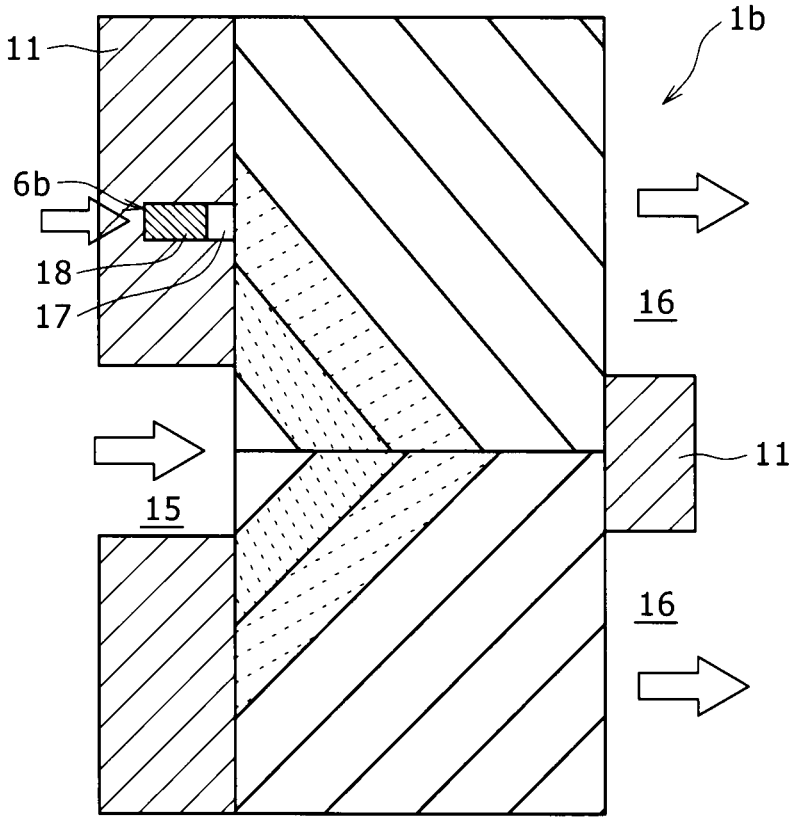
FIG. 9 is a development view of screw rotors of the screw expander of FIG. 8.

FIG. 9 shows a development view of screw rotors 13, 14 of the screw expander 1*b*. In this embodiment, the heat medium sealed in the tooth groove at the moment of separation from the intake flow path 15 expands until this tooth groove reaches the piston valve 6*b* even if the piston valve 6*b* is opened. When the tooth groove reaches the piston valve 6*b*, the heat medium having the intake pressure Ps is further filled into this tooth groove. In the stroke up to this point, the heat medium supplied from the intake flow path 15 is re-compressed after being expanded once. Thus, a slight loss occurs as a whole. A stroke after separation from the piston valve 6*b* is a substantial expansion stroke of the screw expander 1*b*.

Figure 10:
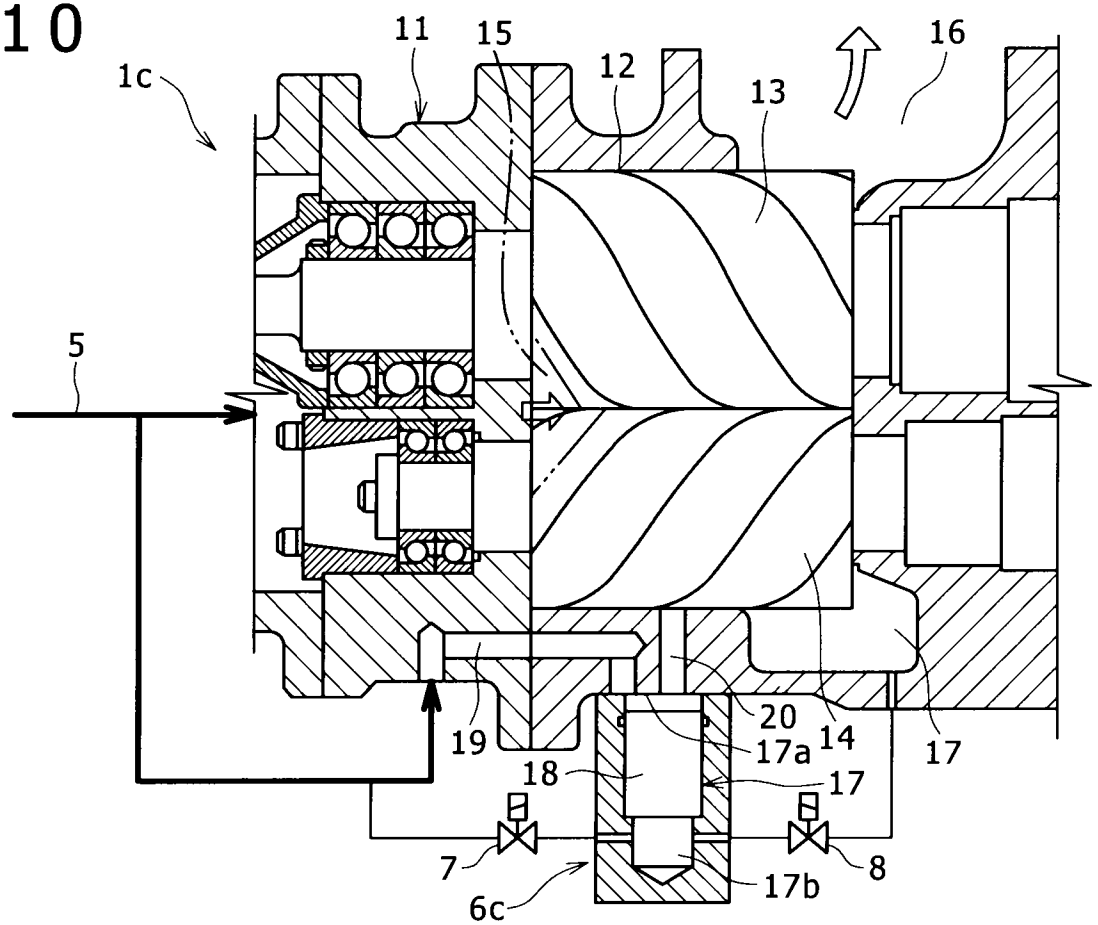
FIG. 10 is a sectional view showing an axial-direction part of a screw expander according to a fourth embodiment of the present invention.

FIG. 10 shows a screw expander 1*c* according to a fourth embodiment of the present invention. In this embodiment, a piston valve 6*c* is so provided as to communicate with a communication flow path 20 which is open to a side surface of a rotor chamber 12. Although the piston valve 6*c* is shown in the same plane as shafts of screw rotors 13, 14 for the sake of convenience, angular positions about the shaft of the screw rotor 14 are so determined as to make the positions of communicating tooth grooves appropriate. In this embodiment, an angle range in which a heat medium having an intake pressure Ps is supplied to the tooth grooves via the piston valve 6*c* can be freely designed by an opening range of the communication flow path 20 with respect to the rotor chamber 12.

Figure 11:
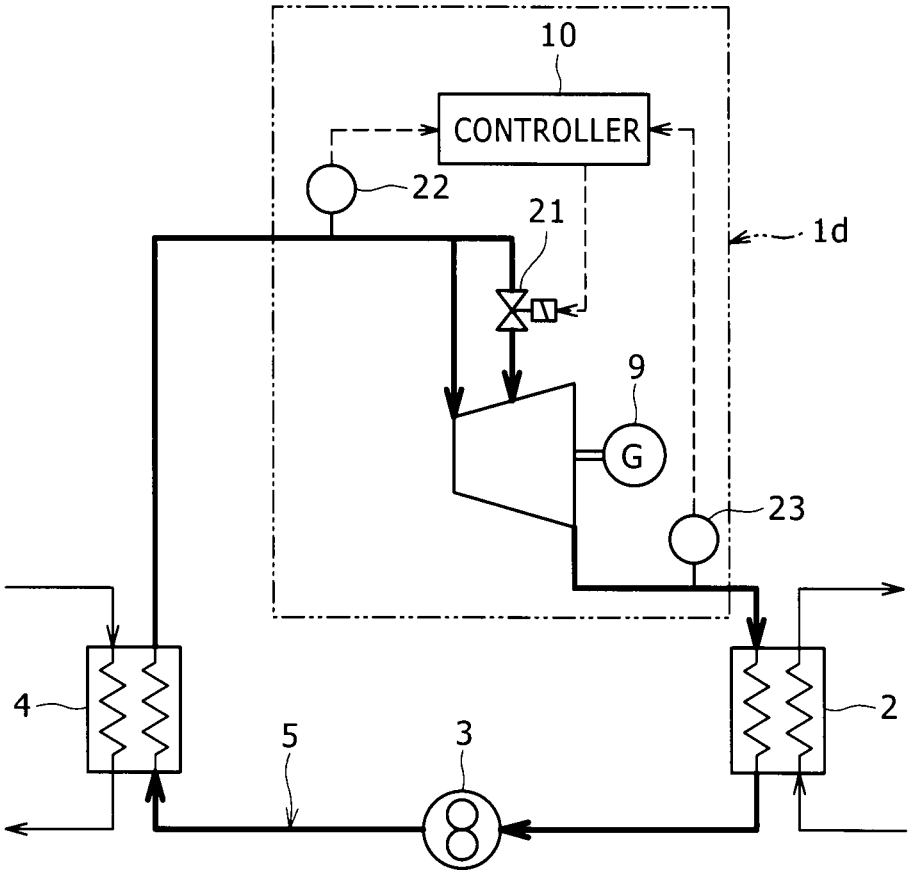
FIG. 11 is a construction diagram of a binary power generation system including a screw expander according to a fifth embodiment of the present invention.

Further, FIG. 11 shows a binary power generation system including a screw expander 1*d* according to a fifth embodiment of the present invention. This binary power generation system is designed to be a small-size power generation system having an output in the order of kW. Accordingly, in the screw expander 1*d* of this embodiment, a flow rate of a heat medium to be supplied to an intermediate pressure portion is low. Thus, a construction such as the piston valve 6 is not necessary as a valve mechanism and an intermediate pressure portion and an intake flow path 15 can be allowed to directly communicate via a circulating flow path 5 only by an electromagnetic valve 21. In the case of a screw expander for a somewhat larger binary power generation system, a motor valve which can be driven by a control power supply (DC 12/24 V) may be used instead of the electromagnetic valve 21.

In the screw expanders of the first to fourth embodiments of the present invention, the piston valve(s) is/are provided only at the side of the female screw rotor 14. That is, the piston valve is so constructed that the bypass flow path 19 and the intermediate pressure portion at the side of the female screw rotor 14 directly communicate by opening the piston valve. However, two or more piston valves may be provided at the side of the male screw rotor 13 in addition to at the side of the female screw rotor 14, and the bypass flow path 19 and an intermediate pressure portion at the side of the male screw rotor 13 communicate at the same time as the bypass flow path 19 and the intermediate pressure portion at the side of the female screw rotor 14 communicate by opening the respective piston valves.

What is claimed is:

1. A screw expander, comprising:

a casing;

an intake flow path provided in said casing;

an exhaust flow path provided in said casing;

a pair of male and female screw rotors housed in a rotor chamber formed in said casing and engaged with each other, said screw rotors converting an expansion force of a high-pressure gas supplied from said intake flow path to said rotor chamber into a rotational force and exhausting a low-pressure gas after expansion to said exhaust flow path;

a bypass flow path provided in said casing and communicating with said intake flow path;

a valve mechanism capable of selectively allowing communication between an intermediate pressure portion, which is a space in said rotor chamber that can be separated from said intake flow path and said exhaust flow path by said screw rotors, and said bypass flow path;

an intake pressure detector for detecting a pressure in said intake flow path;

an exhaust pressure detector for detecting a pressure in said exhaust flow path; and a controller for controlling said valve mechanism in accordance with an operation expansion ratio, which is a ratio of the pressure in said intake flow path detected by said intake pressure detector to the pressure in said exhaust flow path detected by said exhaust pressure detector.

2. The screw expander according to claim 1, wherein said screw rotors and said intake flow path are so formed that said intermediate pressure portion communicates with said intake flow path depending on angles of said screw rotors.

3. The screw expander according to claim 1, wherein said controller causes said valve mechanism to allow communication between said intermediate pressure portion and said bypass flow path when the operation expansion ratio is equal to or below a predetermined set value.

4. The screw expander according to claim 1, wherein said valve mechanism includes:

an intake valve;

an exhaust valve;

a column-shaped space which has a functional end surface communicating with said intermediate pressure portion and said bypass flow path and communicates with said bypass flow path via said intake valve and communicates with said exhaust flow path via said exhaust valve at a side opposite to said functional end surface; and a piston which is fitted in said column-shaped space and separates said intermediate pressure portion and said bypass flow path by coming into contact with said functional end surface.

5. The screw expander according to claim 4, wherein said functional end surface is open at the peripheral edge of an intake-side end surface of said rotor chamber.

* * * * *